US009394713B1

(12) United States Patent
Chen

(10) Patent No.: US 9,394,713 B1
(45) Date of Patent: Jul. 19, 2016

(54) EARTHQUAKE SHELTER

(71) Applicant: Sidney S. Chen, Monterey Park, CA (US)

(72) Inventor: Sidney S. Chen, Monterey Park, CA (US)

( * ) Notice: Subject to any disclaimer, the term of this patent is extended or adjusted under 35 U.S.C. 154(b) by 0 days.

(21) Appl. No.: 13/999,317

(22) Filed: Feb. 11, 2014

(51) Int. Cl.

| | |
|---|---|
| ***E04H 9/02*** | (2006.01) |
| ***E04H 1/12*** | (2006.01) |
| ***E04H 9/14*** | (2006.01) |
| ***E04H 9/16*** | (2006.01) |

(52) U.S. Cl.
CPC ..... *E04H 9/029* (2013.01); *E04H 1/125* (2013.01); *E04H 9/14* (2013.01); *E04H 9/16* (2013.01)

(58) Field of Classification Search
CPC ..... E04H 9/029; E04H 1/125; E04H 9/02; E04H 9/028; E04H 9/14; E04H 9/16; E04H 2009/026
USPC ..... 52/79.1
See application file for complete search history.

(56) References Cited

U.S. PATENT DOCUMENTS

| | | | | |
|---|---|---|---|---|
| 2,607,047 | A | 8/1952 | Posey | |
| 4,389,948 | A * | 6/1983 | Sands | E05G 1/024 109/79 |
| 4,490,864 | A | 1/1985 | Wicker, Jr. | |
| 4,655,012 | A * | 4/1987 | Downey | E04B 1/348 174/363 |
| 4,748,790 | A * | 6/1988 | Frangolacci | E04B 1/98 109/49.5 |
| 4,782,541 | A | 11/1988 | Tuchman | |
| 5,111,543 | A | 5/1992 | Epshetsky et al. | |
| 5,354,126 | A | 10/1994 | Pedrego | |
| 5,575,024 | A | 11/1996 | You | |
| 5,615,424 | A | 4/1997 | Nakata | |
| 5,737,784 | A | 4/1998 | Jackman | |
| 6,298,503 | B1 | 10/2001 | Hsu | |
| 6,349,508 | B1 | 2/2002 | Ju et al. | |
| 6,415,557 | B1 * | 7/2002 | McCalley | E04B 1/08 109/1 S |
| 6,490,830 | B2 | 12/2002 | Ruan | |
| 6,862,847 | B2 * | 3/2005 | Bigelow | E04B 1/34321 220/1.5 |
| 6,874,284 | B1 | 4/2005 | Hayward | |
| 8,549,797 | B1 * | 10/2013 | Ricketts | E04H 9/14 52/79.4 |
| 8,776,449 | B1 * | 7/2014 | Rowan | E04H 1/1205 52/79.1 |
| 2002/0194796 | A1 * | 12/2002 | Kress | E04H 3/08 52/79.1 |
| 2005/0114995 | A1 | 6/2005 | Nakata et al. | |
| 2007/0125012 | A1 | 6/2007 | Quigley et al. | |
| 2013/0031845 | A1 * | 2/2013 | Ali | E04H 9/14 52/79.1 |
| 2013/0145702 | A1 * | 6/2013 | Oba | E04H 9/029 52/167.1 |
| 2014/0326795 | A1 * | 11/2014 | Leclerc | A61M 21/0094 236/1 C |
| 2015/0027505 | A1 * | 1/2015 | Thompson | E04H 1/1205 135/92 |

* cited by examiner

*Primary Examiner* — Brian Glessner
*Assistant Examiner* — Paola Agudelo
(74) *Attorney, Agent, or Firm* — William W. Haefliger

(57) ABSTRACT

An earthquake shelter comprising a container sized for human occupancy, the container having walls and an access opening and a quickly openable and closable primary door to cover and uncover the opening; the container walls and door consisting of high strength panel material, in excess of 10,000 psi load resistance; the container walls including impact shock resisting material that has extensive outwardly presented surface that is outwardly resilient, the wall or walls being flexible; and shock or impact absorbing cushioning means at the container interior, to cushion sudden movement of an occupant relative to the container as the container is suddenly moved by earthquake transmitted force. Tooling enables occupant displacement, from within the container, of debris outside the containers, while viewing such displacement.

17 Claims, 7 Drawing Sheets

23
10
11
33b
20
20
33a
33
~14~
16
15
33c
33d
22
24
12
24

100
6
11
39
50a
16
41
54
50
~14~
60
~31~
51
15
50b
62
24
12
24
6

FIG. 8
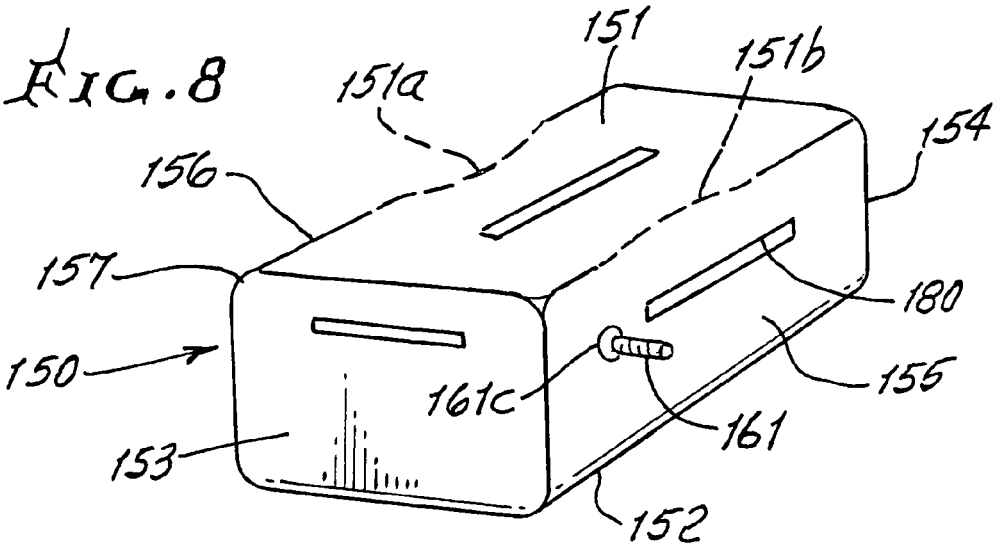
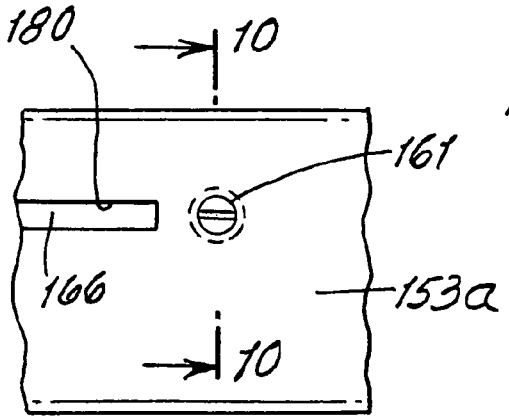
FIG. 9
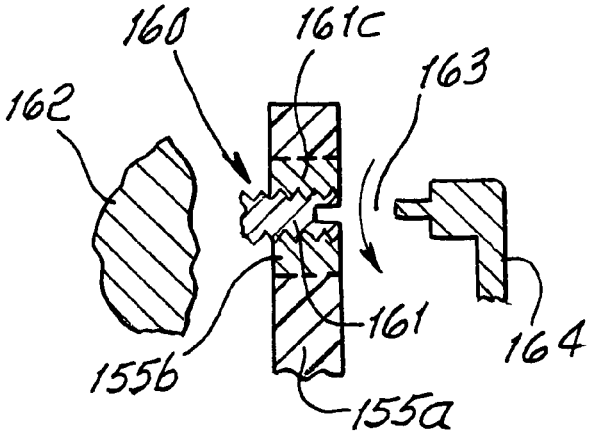
FIG. 10

EARTHQUAKE SHELTER

BACKGROUND OF THE INVENTION

This invention relates generally to survival during earthquakes in local, accessible shelters quickly usable at the beginning of earthquakes and during their continuance.

There is need for efficient, durable and highly accessible shelters installable in buildings for rapid access and use during earthquakes.

In particular, there is need for portable shelters as described herein having the multiple functions and very desirable elements to be described herein.

SUMMARY OF THE INVENTION

It is a major object of the invention to provide an improved protective shelter, easily installable in a building structure, for rapid access and use during an earthquake. Basically the shelter comprises:

a) a container sized for human occupancy, the container having walls and an access opening and a quickly openable and closable primary door to cover and uncover said opening, b) the container walls and door consisting of high strength panel material, in excess of 10,000 psi load resistance, the wall or walls being resiliently flexible, c) the container supported for sliding movement compensating for earthquake induced sideward movement of a supporting surface, d) shock or impact absorbing cushioning means at the container interior, to cushion sudden movement of an occupant relative to the container as the container is suddenly moved by earthquake transmitted force.

In this regard, provision may be made to cushion vertical, i.e. up and down earthquake induced movement of the container, operating in conjunction with sideward sliding compensation, and to move the containers relative to debris at the exterior.

As will be seen, the door is constructed to easily slide open and closed at a side of the container; and a secondary door may be provided for use and during escape from the container, and is easily openable by an occupant of the container chamber in the event the primary door becomes inoperable as by jamming of building debris against the container.

Another object is to provide shelter walls constructed of non-metallic, high strength fireproof material such as i) flexible DELRIN, ii) flexible KEVLAR, iii) high density polyethylene, preferably injected with structural foam.

A further object is to provide a storage sub-container contained within the container, the sub-container having wall structure consisting of high strength panel material and being accessible to an occupant of the container.

Yet another object is to provide a durable window or windows provided in container walls enabling occupant viewing of building debris adjacent or spaced from the container to provide an escape path or route. Also, an openable and closable air vent is provided in a container high strength wall or panel. A high strength storage area is provided in the container, as for example a high strength wall, for equipment such as i) communication equipment, ii) a cell phone or phones, iii) edibles, iv) illumination equipment, v) oxygen supply means.

Walls of the container are of sufficient thickness and size to withstand shock loads to be encountered during building destruction during an earthquake.

These and other objects and advantages of the invention, as for example are listed in the claims, as well as the details of an illustrative embodiment, will be more fully understood from the following specification and drawings, in which:

DRAWING DESCRIPTION

FIG. 8 is an elevation view showing a shelter consisting of resilient, impact resistant, high strength material;

FIG. 9 is a side view of a container wall with an accessible pusher;

FIG. 10 is a section taken on lines 10-10 of FIG. 9, showing occupant use of a pusher advancing tool, to affect shelter displacement;

DETAILED DESCRIPTION

Figure 4:
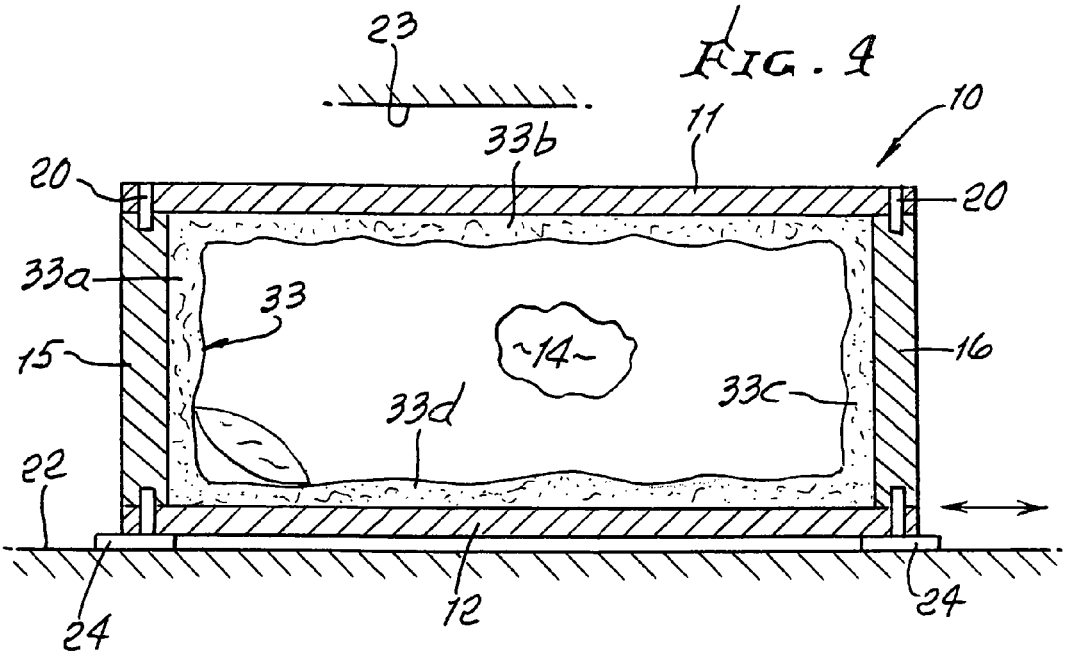
FIG. 4 is a section in elevation showing features of shelter construction.

In the drawings, showing a preferred example, the earthquake shelter 100 is shown to comprise a longitudinally elongated container 10 sized for human occupancy, and including elongated top and bottom walls or panels 11 and 12, supported by elongated upright laterally spaced front and rear walls 13 and 14, and end walls or panels 15 and 16. Such walls may typically be between 1 and 2 inches thick and consist of very high strength material such as KEVLAR, DELRIN or polycarbonate sheet plastic material. Corners may be connected by fasteners as at 20 seen in FIG. 4. Alternatively, the panels may be integrally connected at corners, as during molding. A building floor is schematically indicated at 22, and an overhead building horizontal structure at 23, these being subject to collapse, or partial collapse during an earthquake, with falling debris striking the shelter 10 constructed to withstand such impact. Low friction slider plates 24 are connected to the bottom panel 12, at its corners, and serve to allow limited sliding of the shelter, laterally or horizontally, to compensate for earthquake induced lateral motion transmitted as by building floor 22.

Figure 7:
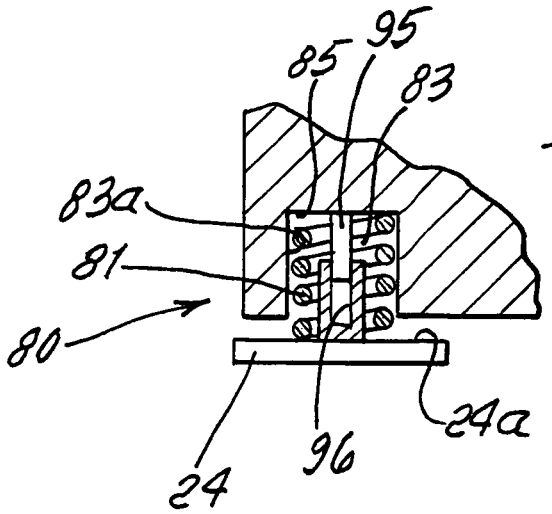
FIG. 7 shows a combined vertical cushioning, and lateral sliding compensation, mechanism.

FIG. 7 shows provision of a dash-pot type cushioning means 80, operating to cushion i.e. dampen, vertical motion of the container, in conjunction with slider plate compensation for lateral motion. One such means 80 as shown in FIG. 7, includes at one or more corners of the container, a helical spring 81 installed in a recess 83 in the container, and confined between recess interior wall 85 and the top surface **24*a* of plate 24. The spring frictionally rubs against recess side wall 83*a* as the spring is compressively displaced endwise, due to impact loading on and displacement of the container, clamping container displacement. See also plunger 95 rubbing against bore 96** as the spring compresses, and also acting as a vertical guide.

The panel 13 forms or defines a front opening 30 sized to permit rapid human access or entry into the container interior 31, for shelter during at least part of the earthquake motion, as during at least the debris falling stage, near the end of the earthquake. The container interior contains yieldable cushioning material 33 indicated at one more locations 33*a*, 33*b*, 33*c*, 33*d*, 33*e* and 33*f*, adjacent the inward facing surfaces of the container walls. Such material serves to cushion sudden relative movement of an occupant and the container, as the container is suddenly moved in response to earthquake transmitted force, or by impact of falling debris. Material 33 may consist of textile or plastic blanketing, batting or other material, of thickness between 2 and 5 inches, for example.

Figure 1:
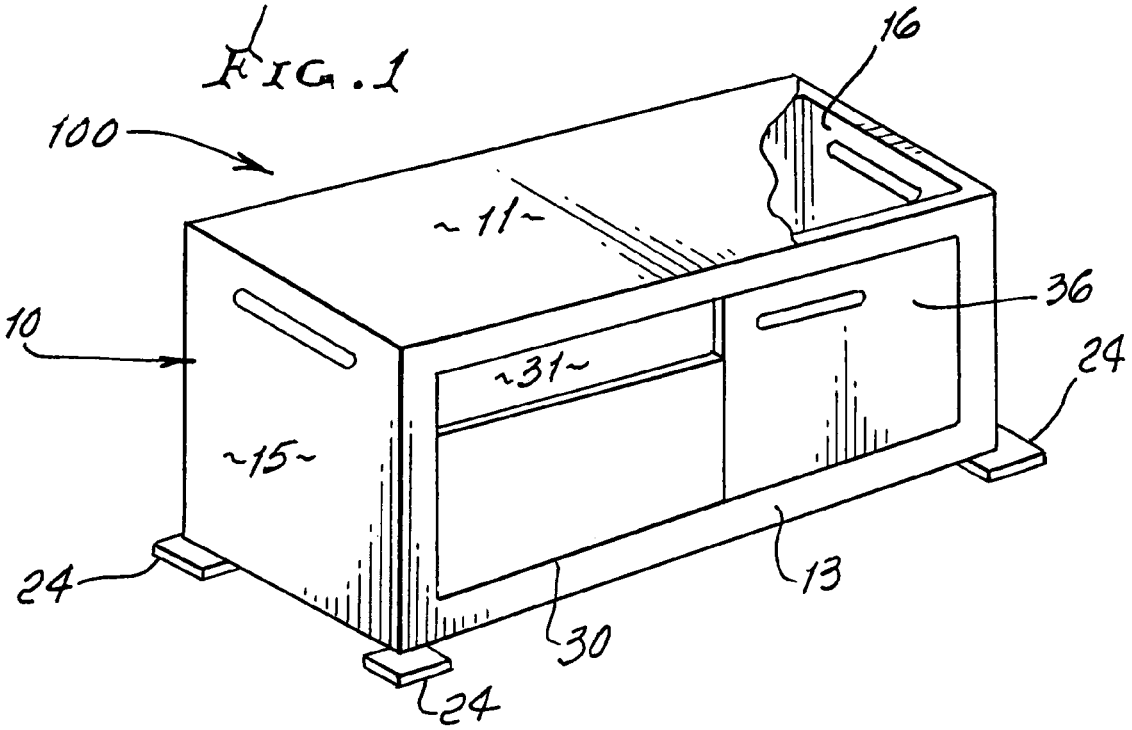
FIG. 1 is a perspective view of a preferred apparatus.
Figure 2:
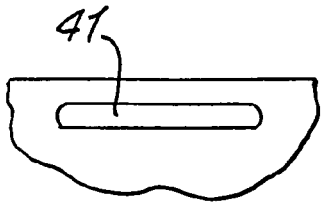
FIGS. 2 and 3 are fragmentary views of window and air vent components provide in a high strength wall.
Figure 3:
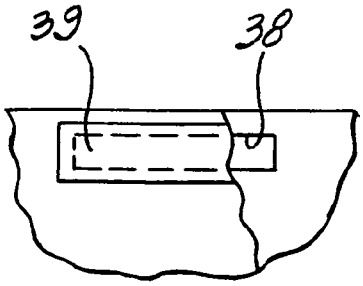

A primary door 36 is manually movable from the container interior to open and close the access opening 30, for protection. See door edge slider guides at 36*a*, and grooves 36*b* in FIG. 6. A supply 37 of the cushioning material at the container interior, may be used to lay against the door interior surface, for cushioning protection, against sudden movement, as referred to. An air vent in at least one wall, as at 38 in wall 14, may be opened or closed from the container interior, as by use of adhesive tape 39 or other means, shown in FIG. 3.

A small observation window or windows 41 is or are preferably provided in one or more container walls, as shown in one or more upright walls 13, 15 and 16, and also in sliding door 36. Such windows may consist of high strength transparent plastic, or glass, edge anchored or molded to the panels, as during panel formation.

A secondary door is provided, as at 50, in the container, and allows occupant escape in the event the primary door is not openable due to jamming, or debris collection at the front side of the primary door 36. Door 50 is shown for example adjacent the end panel 16 in FIG. 5, to close secondary opening 51. It may be carried by a metallic rod 50*a* extending horizontally, inwardly of panel 16, to allow swinging of the door plate 50*b* inwardly and upwardly, exposing opening 51. Normally, the door 50 is retained closed, adjacent opening 51, as by an L-shaped (or other) retainer 62, which is rotatable or twistable to release door retention for upward swinging. Cushioning material 54 is attached to the inner side of door 50.

Figure 5:
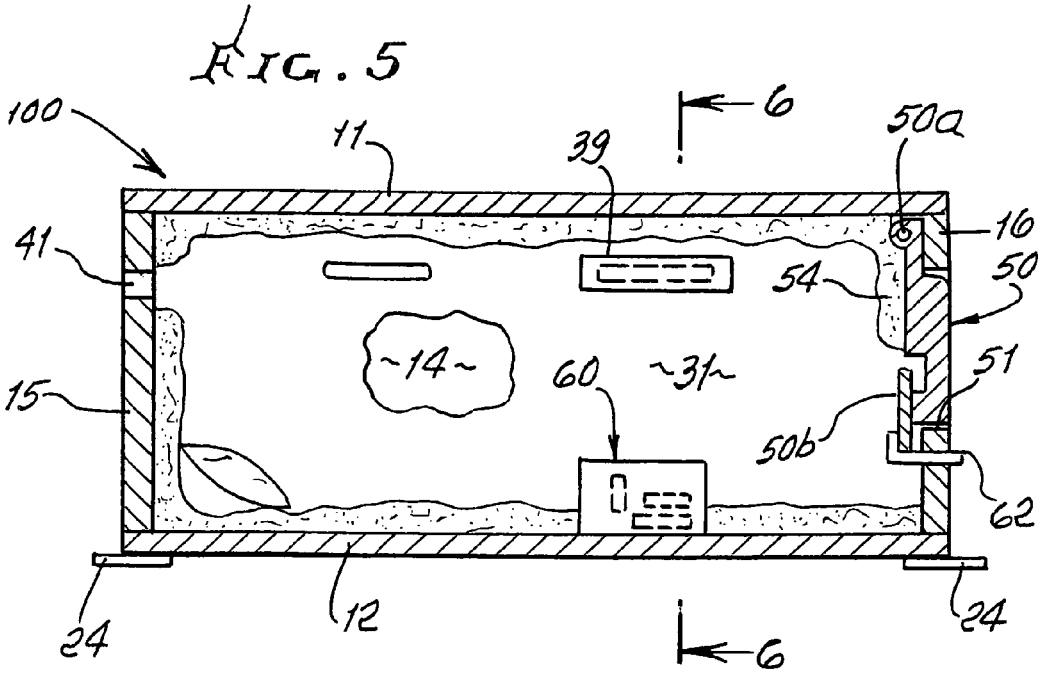
FIG. 5 is a view like FIG. 4, showing further details of shelter construction.
Figure 6:
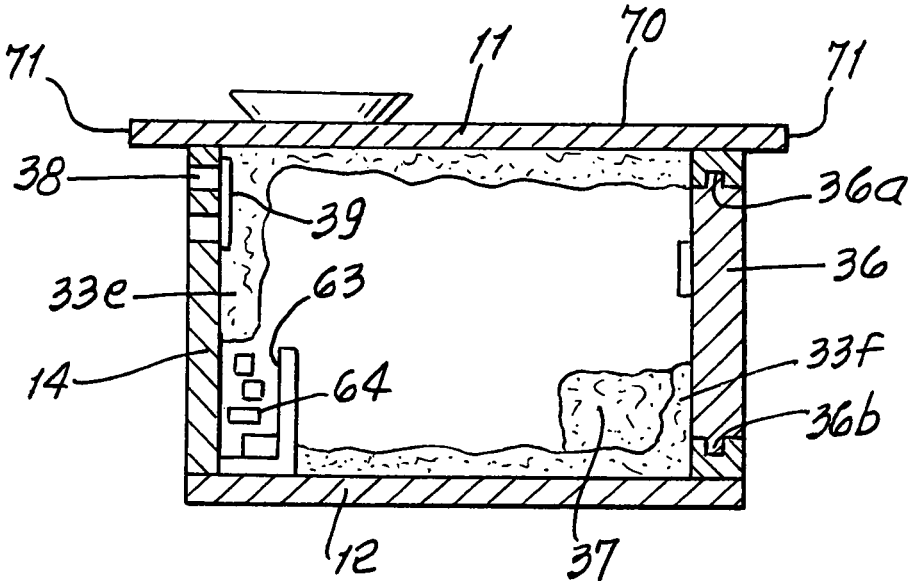
FIG. 6 is a section taken in elevation on lines 6-6 of FIG. 5.

FIGS. 5 and 6 show provision of a storage or sub-container 60 integral with wall 13 at the inner side of that wall. The sub-container consists of high strength panel material and is readily accessible to an occupant of the shelter. The sub-container is shown as upwardly open at entrance 63, for downward reception of useful articles or components 64, such as flashlight
cell phone
radio equipment
edibles and water
first aid supplies
sound emitters such as siren, beepers, etc., for indicating shelter position, for rescue
oxygen supply or compressed air bottle.

Additional optional features include:

a) container top surface 70 serving as furniture surface; see also top horizontal extension flanges 71, b) provision of multiple such containers at different floor levels in building, c) bedding and clothing supply in the container, d) human waste disposal means, as in a pouch receivable in the sub-container.

Referring to FIG. 8, it shows a box-like container 150 having top and bottom walls 151 and 152; end walls 153 and 154; and front and back walls 155 and 156 all consisting of plastic such as foam. Convex or rounded wall junctions are shown as at 157, adding to resilient strength of the walls as during an earthquake. Resilient deflections during heavy impact of the top wall are indicated by broken lines 151*a* and 151*b*. Such impact may be produced by falling debris, rolling of the container or pushing of heavy external material or objects against the container. In all cases, the container is not broken, due to its resilience.

Figure 11:
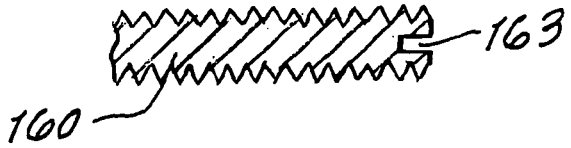
FIG. 11 is a section showing an elongated pusher.
Figure 12:
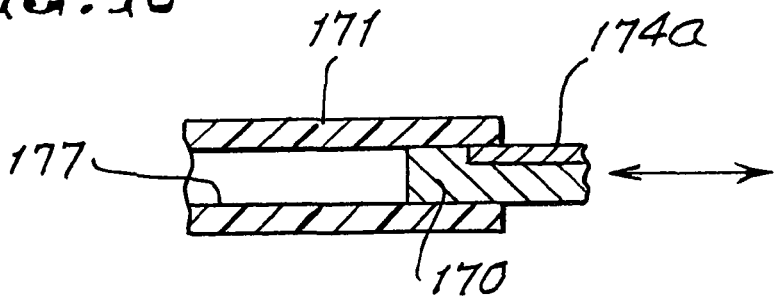
FIG. 12 is a section showing a container shelter wall-sliding door installation.
Figure 13:
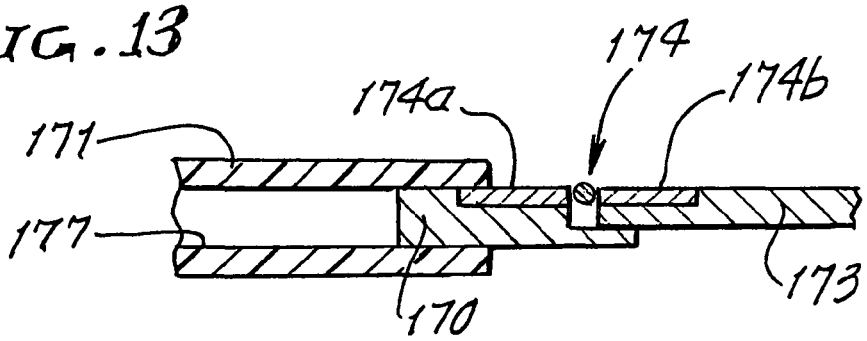
FIG. 13 is a view like FIG. 12, but with addition of a pivoted auxiliary door in case of damage to the sliding door.

Referring to FIGS. 9-11, they show a container wall 155*a* with a pusher 160 carried by the wall and operable by an occupant to create force F usable to displace the container, and possibly free it from jamming in exterior debris, enabling occupant exit via a side door (see FIGS. 12 and 13). The pusher may take the form of a threaded shaft 161, rotatable by handle 164 located in the shelter interior, there being a tongue and groove connection at 163 between the handle and pusher. A threaded socket 161*c* carried by the wall 155*a* receives the shaft, for rotation. As the shaft advances, it engages a rock or other debris 162 and force is created to further separate the rock and container (see FIG. 10). The wall area 155*b* around the socket may be reinforced to better sustain side loading. A viewing slit 180 enables occupant viewing of such progression separation, there typically being a thick glass window 166 in the slit. The limited flexibility of the wall 155*a* enables angular adjustment of the pusher and socket, for pusher engagement of different portions of the rock, directly benefitting control of freeing of the container.

Figure 14:
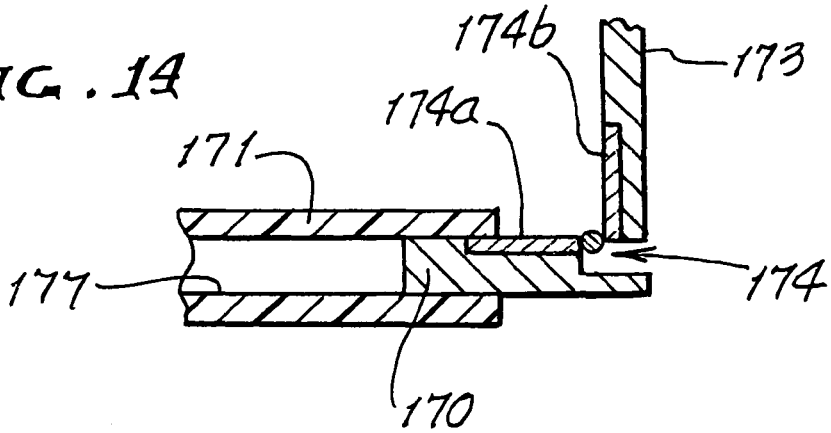
FIG. 14 shows the auxiliary door in pivoted position.

FIGS. 12-14 show a container sliding door 170, slidable in a wall 171 of the container, to allow occupant entrance and exit. An auxiliary door 173 has pivoted connection at 174 with door 170, allowing outward opening of door 173, for occupant exit and entrance, as for example is enabled despite jamming of sliding door 170 in its wall slit, due to heavy and exterior debris damage to door 170, or its slide slot 177. See FIG. 14, with the door 173 in outward pivoted position. Pivoted connection 174 includes hinge plates 174*a* and 174*b*/

Figure 15:
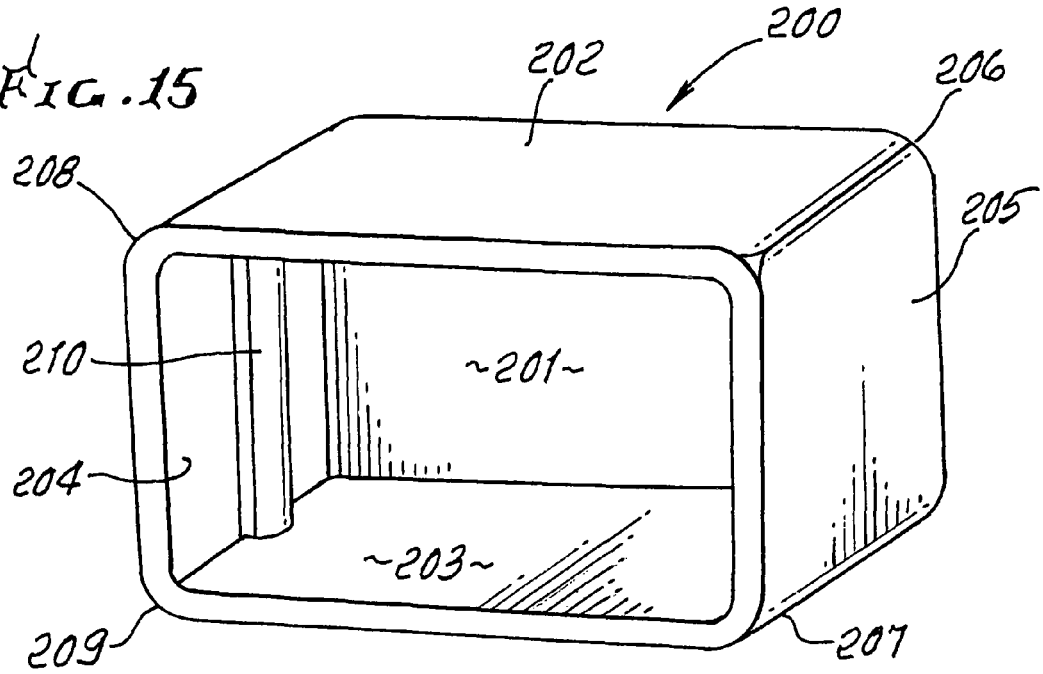
FIGS. 15-17 show further details of container construction.
Figure 16:
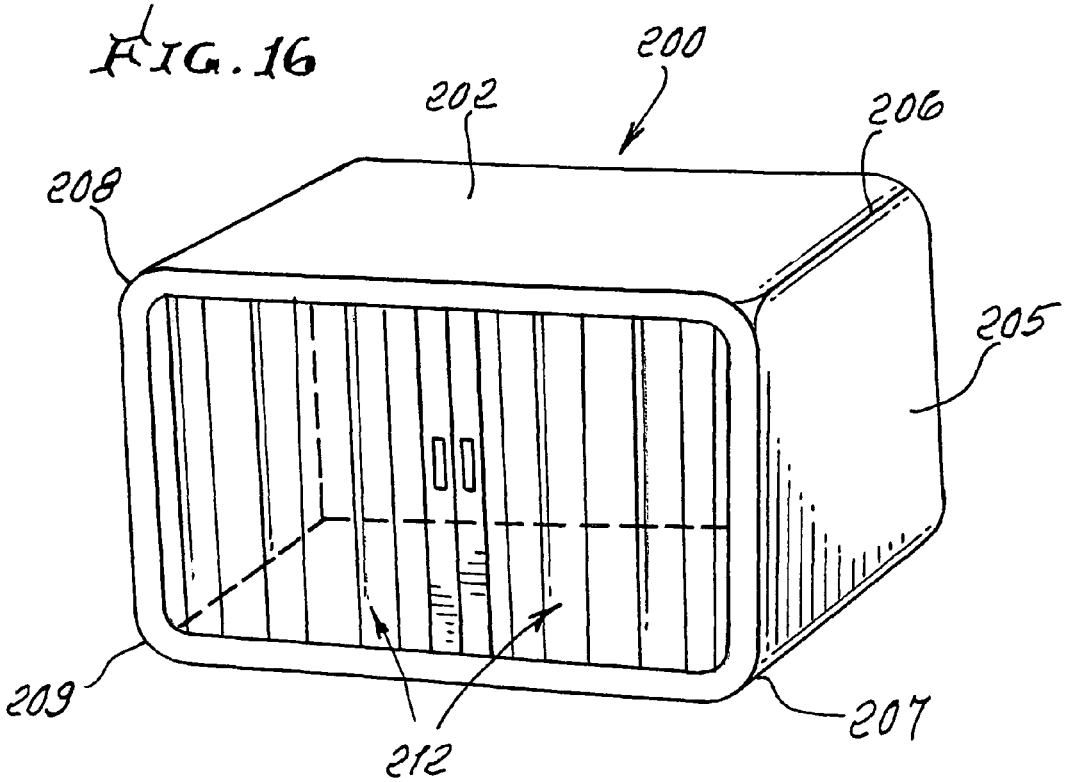

Referring to FIGS. 15 and 16, container 200 has side wall 201, top and bottom walls 202 and 203, end walls 204 and 205, and curved, outwardly convex crush resistant corners, as at 206-209. A "hidden" cylinder 210 contains a sliding door made of flexible KEVLAR material which is 5-7 times stronger and lighter than steel, commonly used for helmet, bulletproof vests in plastic form.

FIG. 16 is like FIG. 15, but shows the sliding curved shutter door 212, deployed into closed or closing position, the resiliently flexible walled container 200 having the following features Material: (High Density Polyethylene) injected with structural foam.
Dimension: 56"W 33"H 28"D
Curved Sliding Door: Flexible KEVLAR material.
Weight: 60 lbs, up.

Figure 17:
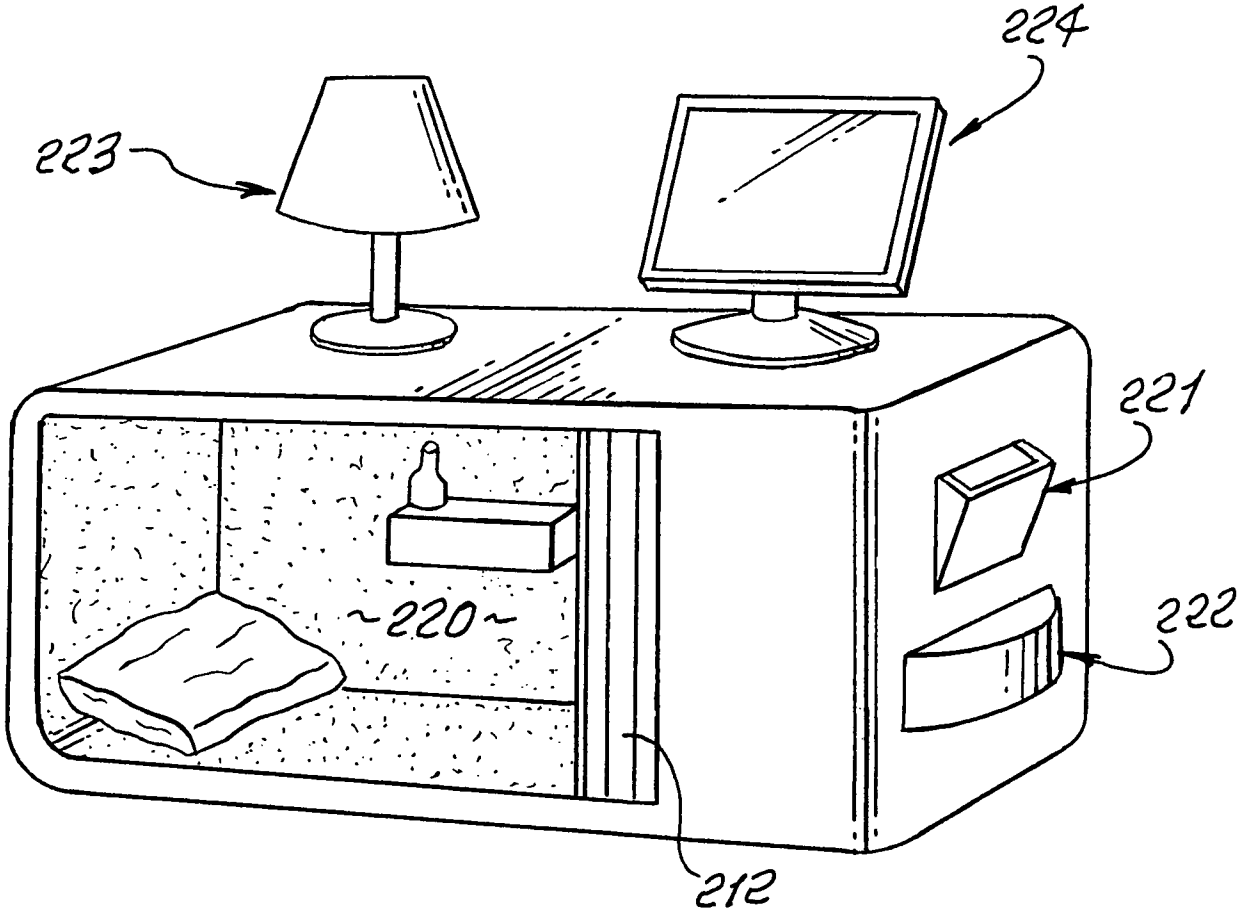

FIG. 17 is like FIGS. 15 and 16, but shows provision of auxiliary equipment: panel inner wall panels 220; bank night deposit fixture 221; lazy susan swivel 222; lamp 223 and computer 224.

What is claimed is:

1. An earthquake shelter comprising:

a) a container sized for human occupancy, the container having walls and an access opening and an openable and closable primary door to cover and uncover said opening, b) the container was and door consisting of high strength panel material, c) the container walls including impact shock resisting material that has an extensive outwardly presented surface that is outwardly resilient, the wall or walls being flexible, d) dash-pot shock or impact absorbing cushioning means at the container exterior, to cushion sudden movement of an occupant relative to the container as the container is suddenly moved by earthquake transmitted force, e) rotary pusher means carried by a wall of the container and projecting therefrom outside the container and through said wall and operable by an occupant to push and displace the container relative to external material, f) said rotary pusher means including a viewing structure and a pusher, said viewing structure positioned at a container wall portion and directed to enable occupant viewing of the pusher advancement at the container exterior, g) said rotary pusher means further including:

a structure forcibly rotatable by an occupant of the container, to advance the pusher toward the container exterior to engage and push against external material the pusher including an elongated threaded part projecting in a wall portion of the container in a direction toward the container exterior; and a pusher socket that is adjustable relative to the container wall and receives the pusher, h) there being a secondary door provided in a wall opening defined by the container, and openable from the container interior, without diminishing container impact strength.

2. The shelter of claim 1 wherein the container is elongated and has side and end walls which are outwardly resiliently displaceable, and outwardly convex corners, there being structurally shock resistant resilient material associated with said walls.

3. The shelter of claim 1 wherein the container defines panel material selected from the group consisting of:

i) resiliently flexible structure, ii) resiliently flexible, crush resistant structure, iii) high density polyethylene, preferable injected with structural foam.

4. The shelter of claim 1 wherein said cushioning means comprises layers of insulative cushioning material applied to inner sides of said wall.

5. The shelter of claim 1 including viewing means positioned at a container wall portion and directed to enable occupant viewing of pusher advancement at the container exterior.

6. The shelter of claim 5 comprising upright building structure having one or more rooms, the shelter located in one of said rooms to be quickly available to room occupants in the event of an earthquake.

7. The shelter of claim 1 wherein the shelter has elongated box configuration.

8. The shelter of claim 7 wherein said walls are of sufficient thickness and size to withstand shock loads to be encountered during building destruction during an earthquake.

9. The shelter of claim 1 including a small window or windows provided in container walls enabling occupant viewing of building debris locations adjacent or spaced form the container, to provide for viewing of an escape path or route.

10. The shelter of claim 1 including an openable and closable air vent in a one of said walls.

11. The shelter of claim 1 wherein the secondary door has pivotal mounting to the primary door which is slidable, to be opened relative to the slidable primary door.

12. The shelter of claim 1 including one or more of the following stored in the container:

i) a cell phone or phones, ii) oxygen supply means.

13. The shelter of claim 1 wherein said walls are of thickness, flexibility and size to withstand shock loads to be encountered during an earthquake.

14. The shelter of claim 1 including a container vertical movement resisting means at one or more locations on the container.

15. The shelter of claim 14 wherein said dampening means includes a spring and functional damper.

16. A method of operation of the shelter of claim 1 by a shelter occupant, that includes rotating a tool within the shelter to rotate said pusher to create force pushing against said outside material, and providing force to move the shelter relative to said outside material.

17. The method of operation of the shelter of claim 16, that includes also viewing said external material via a viewing slit in the container wall, in conjunction with rotating of said tool, whereby movement of the shelter relative to said outside material may be determined.

* * * * *